US009745028B2

(12) United States Patent
Blattmann et al.

(10) Patent No.: US 9,745,028 B2
(45) Date of Patent: Aug. 29, 2017

(54) STERN TRANSOM AND SEATING OF A COLLAPSIBLE BOAT HULL

(71) Applicant: Flat Out Dreaming Pty Ltd., Subiaco (AU)

(72) Inventors: Lee Blattmann, Castle Cove (AU); Giovanni Ciampa, Gladesville (AU); Deryck Fletcher Gow Graham, Cottesloe (AU)

(73) Assignee: Flat Out Dreaming Pty Ltd., Subiaco (AU)

( * ) Notice: Subject to any disclaimer, the term of this patent is extended or adjusted under 35 U.S.C. 154(b) by 0 days.

(21) Appl. No.: 14/894,593

(22) PCT Filed: May 30, 2014

(86) PCT No.: PCT/AU2014/050057
§ 371 (c)(1),
(2) Date: Nov. 30, 2015

(87) PCT Pub. No.: WO2014/190397
PCT Pub. Date: Dec. 4, 2014

(65) Prior Publication Data

US 2016/0121976 A1 May 5, 2016

(30) Foreign Application Priority Data

May 31, 2013 (AU) ..... 2013901966

(51) Int. Cl.
*B63B 7/00* (2006.01)
*B63B 29/04* (2006.01)
(Continued)

(52) U.S. Cl.
CPC ..... *B63B 29/04* (2013.01); *B63B 3/12* (2013.01); *B63B 5/24* (2013.01); *B63B 7/04* (2013.01);
(Continued)

(58) Field of Classification Search
CPC .... B63B 7/00; B63B 7/02; B63B 7/04; B63B 9/00; B63B 9/062; B63B 2009/006; B63B 29/04; B63B 2029/043
(Continued)

(56) References Cited

U.S. PATENT DOCUMENTS 2,504,225 A 4/1950 Randrup
3,639,933 A * 2/1972 Trowbridge ..... B63B 7/06 114/354

(Continued)

FOREIGN PATENT DOCUMENTS

AU 2011226921 B2 10/2011
GB 2223459 A 4/1990

OTHER PUBLICATIONS

International Search Report and Written Opinion for PCT/AU2014/050057, dated Aug. 21, 2014.

*Primary Examiner* — Daniel V Venne
(74) *Attorney, Agent, or Firm* — Bachman & LaPointe, P.C.

(57) ABSTRACT

A collapsible boat hull (10) with at least one bottom panel (16,18) and two side panels (12,14), and a removable transom (32) with attachment means (36) to engage the transom with the two sides of the boat hull, such that, during installation of the transom member, the attachment means initially engages with the sides of the boat, and rotation of the transom to an upright position in the boat hull retains the attachment means and the respective sides of the boat hull together. Releasable latches (42,44) at the lower edge of the transom engage with retaining members (54) on the bottom panels. Seating or cross-bracing has (100) which releasably engage with retainers on the sides of the boat.

20 Claims, 7 Drawing Sheets

(51) Int. Cl.

| | |
|---|---|
| ***B63B 3/12*** | (2006.01) |
| ***B63B 5/24*** | (2006.01) |
| ***B63B 7/04*** | (2006.01) |
| ***B63B 9/00*** | (2006.01) |

(52) U.S. Cl.
CPC ..... *B63B 9/00* (2013.01); *B63B 2009/006* (2013.01); *B63B 2029/043* (2013.01)

(58) Field of Classification Search
USPC ..... 114/343, 352, 353, 354, 363, 364
See application file for complete search history.

(56) References Cited

U.S. PATENT DOCUMENTS

| | | | | | |
|---|---|---|---|---|---|
| 4,282,616 | A * | 8/1981 | Battershill | B63B 7/02 | 114/354 |
| 4,911,095 | A * | 3/1990 | Kaye | B63B 7/06 | 114/354 |
| 5,372,085 | A * | 12/1994 | Kaye | B63B 7/06 | 114/352 |
| 5,488,922 | A * | 2/1996 | Hinderberger | B63B 7/02 | 114/354 |
| 5,704,310 | A | 1/1998 | Cittadini | | |
| 7,314,018 | B2 * | 1/2008 | Ager | B63B 7/02 | 114/354 |

* cited by examiner

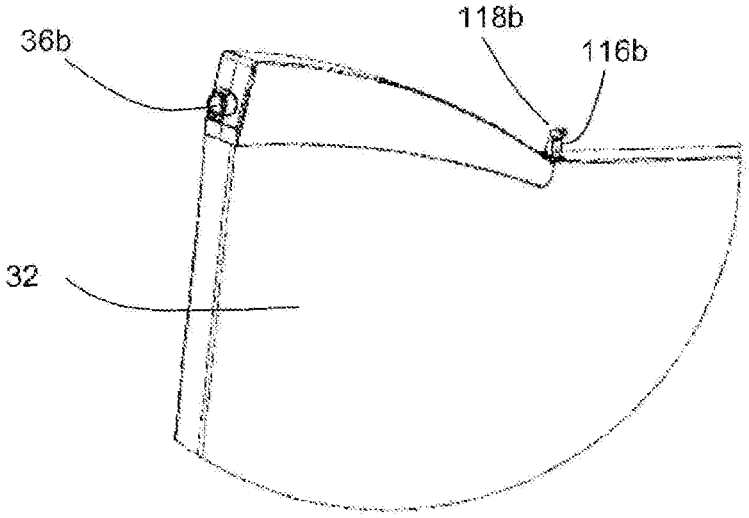
Fig 18
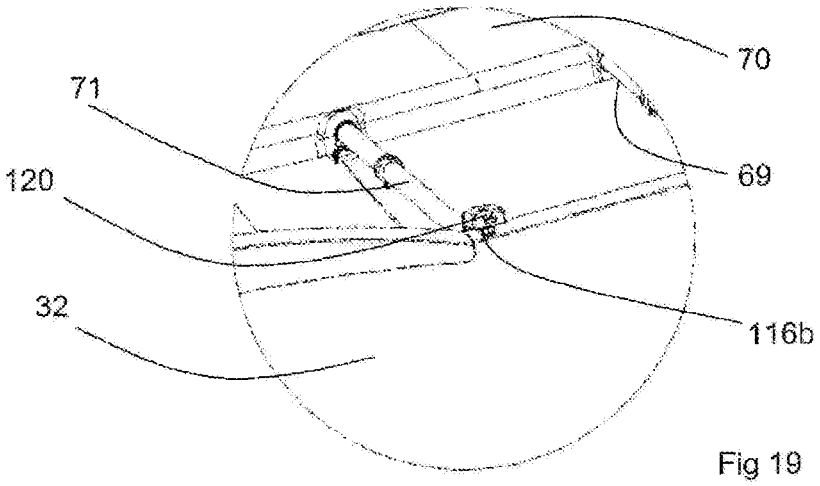
Fig 19
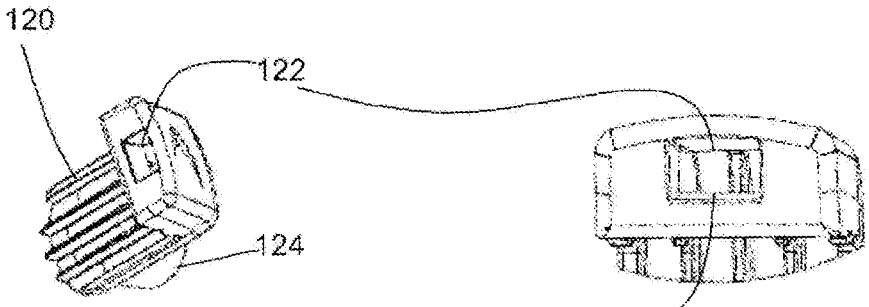
Fig 20
Fig 21

STERN TRANSOM AND SEATING OF A COLLAPSIBLE BOAT HULL

FIELD OF THE INVENTION

The present invention relates to stern transom for a collapsible boat hull which can be readily installed when erecting the boat for use and removed for ease of transportation of the boat hull when collapsed.

The present invention further relates to removable seating or cross brace for a boat hull.

BACKGROUND TO THE INVENTION

It is known to provide collapsible boat hulls incorporating a pair of hinge interconnected bottom panels and a pair of side panels hinged to the bottom panels. Such boats can be collapsed and folded along the hinging edges of the panels into a substantially flat configuration.

Some collapsible boat hulls are provided with a prow at either end of the hull, avoiding having a stern transom member. However, more typically collapsible boat hulls are also provided with some form of stern member functioning as a transom, and seats removably mounted onto the boat hull when the boat hull is in an erected configuration.

Some collapsible boat hulls have rigid transoms, which may be stern panels hinged to the sides panels, such that two transom panels hinge from the respective side panels to overlap and provide a transom at the stern of the boat Others collapsible boats are provided with diaphragms to prevent ingress of water past the transom panel(s). The diaphragm can accommodate rigid panels, which rigidify and stabilise the diaphragm when an outboard motor is mounted thereon.

It has been realised that simply providing a rigid transom member, whilst forming a stern to the boat hull, does not aid rigidity of the hull unless effective mounting is provided that allows the transom to be readily mounted to the unfolded hull and readily removed to allow the hull to be collapsed for transport, and once mounted in position in the hull also provides support to the hull and has effective retention means.

Provision is generally also made to mount an outboard motor on the transom. It is necessary that the transom is sufficiently strong and mounted sufficiently well to the hull in order to transfer forces from the outboard motor in the hull for propulsion.

It is also known to provide removable seating that is installed into the boat hull to brace the sides of the boat as well as to provide seating.

Often a collapsible boat will need to be erected and put into the water by one person. Having a transom and seating that can be readily installed and removed by that one person would be of great practical benefit to the user.

Seating for known collapsible boats often requires latch bolts or other catches that are relatively tricky to use, particularly singlehandedly. Installing seats often requires both sides of the seat to be latched at the same time. Releasing seats from the hull can also require releasing latches/bolts at both sides of the boat before the seat can be lifted out of the hull. Known latches/bolts arrangements have been found to be cumbersome and awkward to use, particularly for one person erecting/collapsing the boat on their own.

The present invention attempts to address at least in part some of the aforementioned disadvantages.

SUMMARY OF THE INVENTION

With the aforementioned in mind, in one aspect the present invention provides a collapsible boat hull having at least one bottom panel and two side panels, and a removable transom member, the transom member including attachment means arranged to engage with the two sides of the boat hull, such that, during installation, the attachment means initially engages with the sides of the boat, and rotation of the transom member to an upright position in the boat hull retains the attachment means and the respective sides of the boat hull together.

In a further aspect of the present invention, a collapsible boat hull has at least one bottom panel and two side panels, and a removable transom member, the transom member including attachment means arranged to engage with the two sides of the boat hull, such that, during installation, the attachment means engages with the sides of the boat and rotation of at least a portion of the attachment means retains the transom member in an upright position at the stern of the boat hull.

It will therefore be appreciated that the removable transom member may be initially engaged with the side panels and the attachment means actuated by rotation of at least part of the attachment means to lock the transom member to its upright position, or the transom member may be initially engaged with the side panels through the attachment means, and the transom member rotated to cause the attachment means to releasably lock the transom member to the side panels.

Release of the transom member from the sides of the boat hull may be achieved by rotating the transom member away from its installed upright position and releasing the attachment means from the sides of the boat hull, or by rotation of the part of the attachment means.

Engagement of the attachment means to the sides of the boat may also draw the sides of the boat to the transom, which helps to brace the boat and provide rigidity.

Preferably the boat hull includes a diaphragm across a stern of the hull, which diaphragm is supported by the transom member when the transom member is installed in the boat hull. The transom member may be rotated into its upright installed position from within the boat hull to lie adjacent the diaphragm with the diaphragm external of the hull relative to the transom member.

The releasable attachment means may include bayonet or cam type releasable fasteners to attach the transom member to the respective side panels. Far example, when installing the transom member into the boat hull, a bayonet or cam arrangement may engage each upper side of the transom member and respective side member of the boat hull such that, as the transom member is pivoted to an installed position, the bayonet or cam arrangement positively connects or locks the respective sides to the transom member. This arrangement can 'pull' the sides and the transom member together to create a positive tension and help rigidify the hull. It will be appreciated that, in preferred embodiments, the transom member cannot be released from the boat hull until it is rotated/pivoted away from its upright installed position to a release position.

The release position for the transom member may be horizontal or at an angle above or below horizontal, preferably no more than 30° above or below horizontal.

The sides or transom member may have the bayonet or cam arrangement, and the other of the transom member or sides may have a receiving arrangement for the bayonet or cam arrangement.

Preferably retaining means locks the transom member to the bottom of the boat. Thus, the transom member may be provided with retaining means to lock the transom member to the bottom of the boat. The retaining means may have or cooperate with respective one or more retaining portions provided within or on the bottom of the boat. Thus, as or once the transom member is rotated into its installed position, the retaining means engages the transom member to the bottom of the boat to prevent the transom member from rotating back. The installed transom member supports the diaphragm against water pressure when the boat is in water. The retaining means prevents the transom member from rotating inwards with respect to the boat hull and thereby prevents loss of support for the diaphragm.

It will be appreciated that the boat hull need not have a diaphragm. One or more seals may be provided between the transom member and the bottom and sides of the boat hull to prevent ingress of water. Such one or more seals may be provided on the transom member, on the sides and/or bottom of the hull, or on the transom member and the sides and/or bottom of the boat hull. Thus, rotating the transom member into position can also effect sealing between the transom member and hull against ingress of water by use of the seal(s).

The retaining means may include a release arrangement, such as at least one release handle operatively connected to at least one respective retaining means release latch. The at least one release handle may be provided in or on the transom member, such as at least one recessed release handle in the body of the transom member. The at least one release handle may be arranged and configured for foot or hand operation. That is, the term 'handle' does not limit operation of the release handle(s) to hand operation, and a user may employ foot operation in one or more embodiments.

The at least one release handle may be operatively connected to the respective at least one release latch by a release actuator, which may include one or more elongate members, such as one or more rods or cables. The release actuator(s) may be provided within the material or body of the transom member or may be provided under a cover attached to an external surface of the transom member.

A further aspect of the present invention provides a boat hull cross brace or seat attachment system, the boat hull including two sides and a bottom, the attachment system including an inter co-operating releasable attachment arrangement between the cross brace or seat and the sides of the boat, wherein the brace or seat includes a first member of a said releasable attachment arrangement at one end thereof and a second member of a said releasable attachment arrangement at a second opposed end thereof, each of the first and second members engaging with a respective retainer on the respective side of the boat.

Preferably the boat hull is collapsible. More preferably, the boat hull and seat(s) may be stowed in one or more bags for ready transportation once the seating is removed form the hull and the boat hull is collapsed. Thus, the collapsible boat hull may be a flat pack hull.

The releasable attachment arrangement preferably includes a release catch on one or both of the ends of an elongate seat or brace. The release catch may be manually operated to release the respective end of the seat/brace from engagement with a retainer on the side panel. Alternatively, a said retainer may be provided at each end of the seat and a release catch provided on each side of the boat.

The release catch may have a catch member biased to a catch position, whereby, operation, of the catch member enables release of that and of the seat or brace from engagement with the retainer on the boat side.

The catch member may be biased by a biasing means, such as a spring or resilient member. The catch member may include a jaw that engages with a portion of the retainer to retain the seat or brace to the side panel. The jaw may be released by manual operation.

The first and second members may include an engaging portion to locate and engage with a respective portion on the respective retainer. It will be appreciated that the retainer is attached to the side panel, such as by bonding and/or one or more fasteners, such as bolts or rivets. Bonding, such as by an adhesive (e.g. a marine grade epoxy) is preferred. The retainer supports the seat or brace relative to the side panel.

It will also be appreciated that release of the seat or brace from the retainers on the side panels to remove the seat or brace from the boat hull may be achieved by operating the release catch on one end of the seat or brace, lifting that end of the seat or brace to a required angle with respect to the retainer at the other end, until the catch on the seat or brace at that other end reaches a release position, whereby the seat or brace can be lifted free from the boat hull.

A further aspect of the present invention provides a method of releasing a seat or cross brace from a boat hull, the method including operating a release means at a first end of the seat or cross brace, lifting that end of the seat or brace to a required angle with respect to a retainer holding the opposite end of the seat or cross brace until the seat or cross brace at that opposite end reaches a release position, whereby the seat or cross brace is released to be removed from the boat hull.

A seat angle of between 10° and 50° relative to its installed position is envisaged as sufficient to allow automatic release of the distal end of the seat relative to the manually operated release at a [proximal end of the same seat. Thus, a user can manually release a seat retaining catch at one end of the seat, raise that end of the seat upwards until a required angle is reached, at which point the opposite (distal) end of the seat is released from retention and can be lifted away from the retainer at that distal end of the seat.

The angle of automatic release of the distal end of the seat when the proximal end is lifted may be in the range, 15° to 45°, preferably 15° to 30° and more preferably within the range 20° to 30°. A preferred angle is about 25°.

Alternatively, manual release can be made at both ends of the seat by two users acting in harmony to remove the seat at about the same time, or a single user manually releasing one end of the seat from its retainer, moving to the opposite side of the boat hull and manually releasing that opposite side of the seat.

BRIEF DESCRIPTION OF THE DRAWINGS

The present invention will now be described, by way of example, with reference to the accompanying drawings, in which:

FIG. 6 shows an attachment member on the transom member and FIG. 7 shows a cooperating, receiving member on the side panel to receive the attachment member.

FIGS. 18 to 21 show features of a transom-seat brace attachment arrangement according to a further embodiment of the present invention.

DESCRIPTION OF PREFERRED EMBODIMENT

Figure 1:
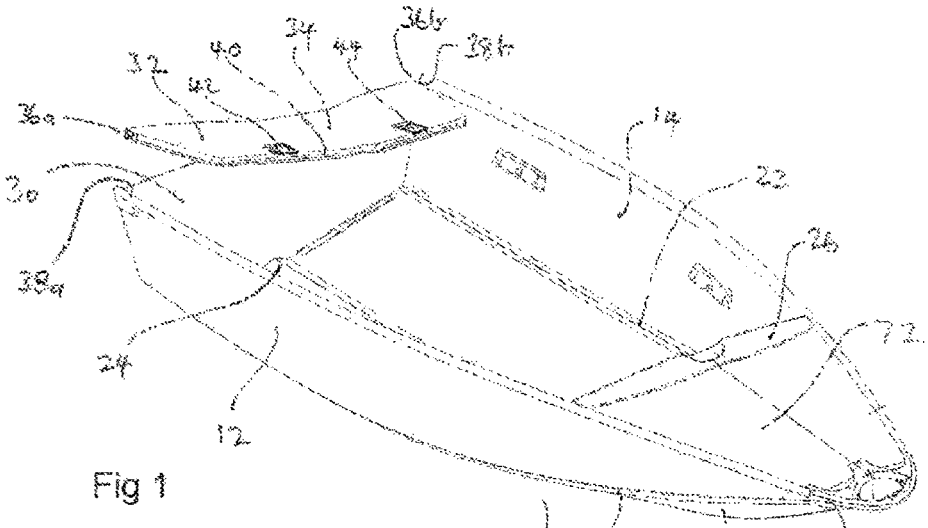
FIGS. 1 to 4 show stages of installing the pivot/rotate in place transom member into a collapsible boat hull according to an embodiment of the present invention.

Referring to the accompanying figures, there is shown a collapsible boat hull 10 with side panels 12,14 and bottom panels 16,18. The side panels are each joined to a respective one of the bottom panels by a flexible hinge 20,22. The bottom panels are joined to each other by another flexible hinge 24.

A cross brace 26 helps to maintain rigidity towards the bow 2 of the erected boat.

A diaphragm (or membrane) 30 closes the stern of the boat hull. When the boat hull is opened out, the transom member 32 can be positioned into the stern of the boat hull.

In the embodiment shown, the transom member includes a rigid panel 34 incorporating an attachment means in the form of a releasable pivot/rotation means having a releasable fastener portion 36 (36*a*,36*b*) on the upper edge of each end of the transom member and a respective cooperating fastener portion 38 (38*a*,38*b*) on the inner upper rear of each side panel.

With the boat hull opened out, as shown in FIG. 1, the transom member 32 releasable fasteners are engaged into the respective cooperating fastener portions on the upper rear of each side panel.

Figure 2:
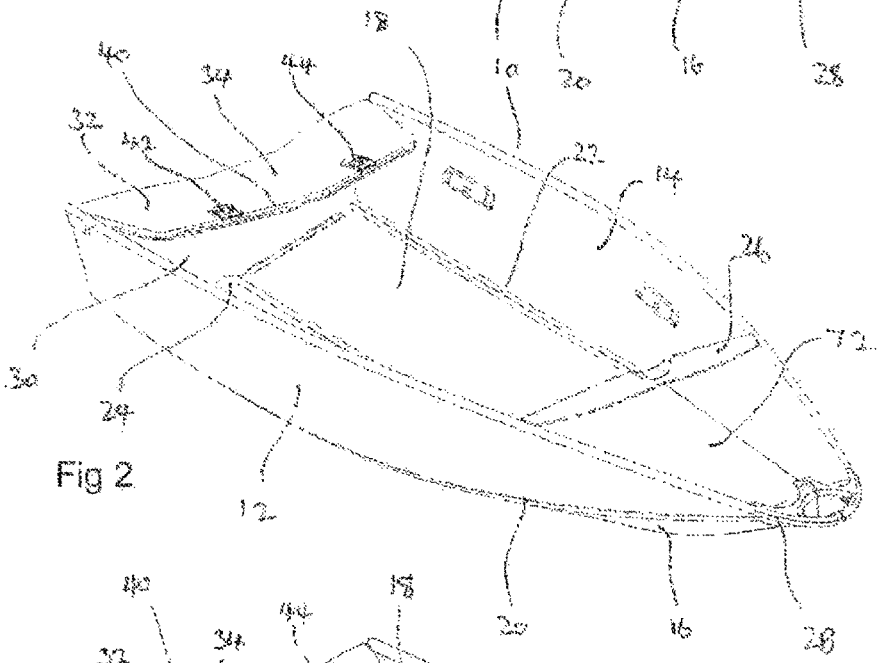
Figure 3:
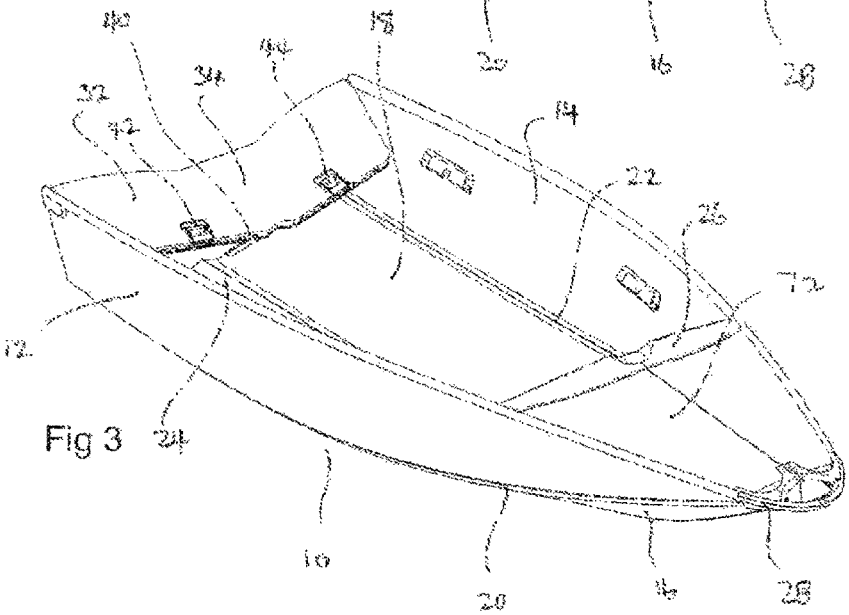
Figure 4:
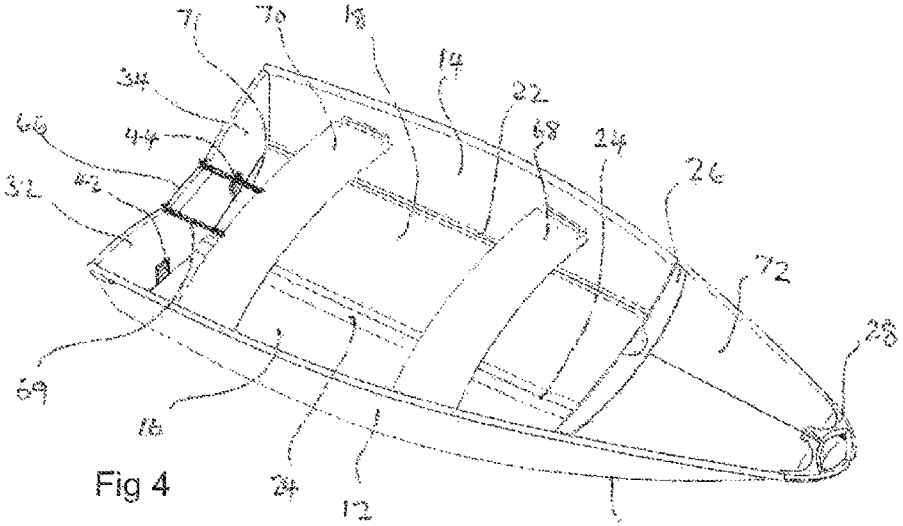

As shown stepwise in FIGS. 2 to 4, the transom member is then rotated downwards, pivoting about the fastener means, until the lower edge 40 of the transom member is adjacent the bottom of the boat hull.

The transom member 32 includes a mount 66 for an outboard motor (not shown). Removable seats 68,70 are provided within the boat. A cover 72 goes over the bow end of the bat between the cross brace and the bow cover.

Figure 5:
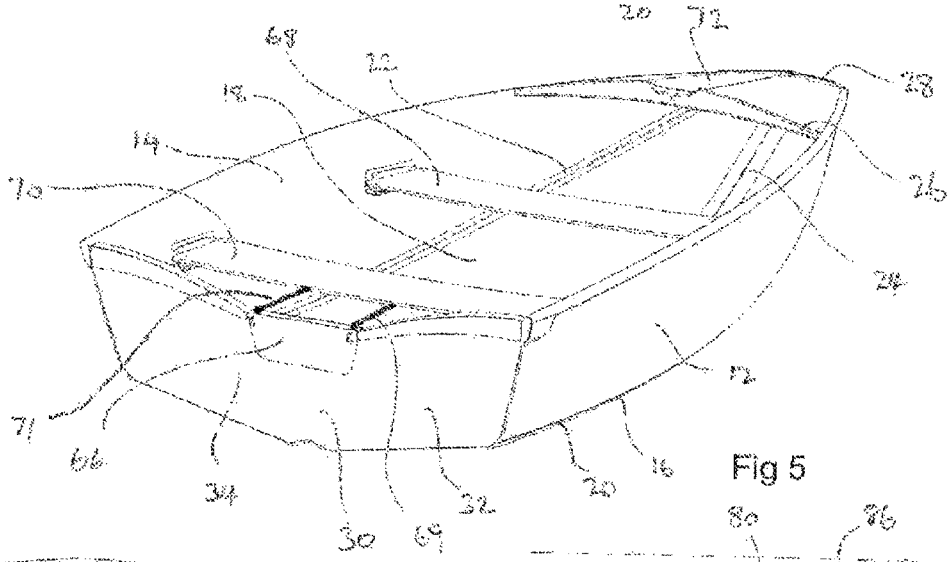
FIG. 5 shows a stern view the collapsible boat hull with pivot/rotate in place transom member installed according to an embodiment of the present invention.

As shown in FIGS. 4 and 5, struts/braces 69,71 can be positioned between the rear seat 68 and the removable transom member 32. The term strut and brace will be used interchangeably in the following specification, and reference to one is reference to the other. These struts connect between the engine mounting plate and the rear of the rear seat. The struts help to transfer forces and any vibration from an outboard motor to the rear seat and therefore into the sides of the boat hull.

FIGS. 18 to 21 show features of a preferred embodiment of a connection arrangement between the strut/brace 69,71 and the transom 32.

FIG. 18 shows a section of the transom 32 with a projecting stud 116*b* with a rearward facing hook portion 118*b*. It will be appreciated that a similar projecting stud 118*a* will be mounted on the adjacent side of the transom.

FIG. 19 shows a section in close up of the end portion 120 of the strut/brace 71 providing the port side brace/strut between the seat/thwart 70 and the transom 32. The end portion 120 hooks over the projecting stud 116*b* (and similarly 116*a* on the starboard side). FIGS. 20 and 21 show detail of the end portion 120. The end portion can plug into the end of the strut/brace via projection 124. The opening 122 has a lip 126 over which the hook portion 118*a*,118*b* connects to positively encage with the end portion 120. The hook is therefore effectively housed in the opening of the end portion and allows the boat hull to be lifted via the strut(s)/brace(s) or seat/thwart for transport.

Preferably, the struts 69,71 can include means 120 to releasably connect with respective projections 116*a*,116*b* on the upper edge of the transom. In one arrangement, openings 122 provided on respective end portions 120 of the struts ('thrust poles') hook over upright projections from the transom, such that gravity and the weight of a person would retain the brace(s) connected to the transom and thereby help to transfer thrust forces from the motor through the transom to the seat.

However, it has been realised that more positive engagement between the struts/braces and the transom can assist in providing one or more lifting points (effectively one or more handles) to aid transport and lifting of the boat hull when erected and assembled. This positive connection between the struts/braces and the transom avoids users lifting the seat out in a less than optimal way and risk damaging the seat mounting points e.g. the seat clips and retainers.

Furthermore, positive engagement of the brace(s) and transom together beneficially improves structural integrity of the boat hull when erected.

In a preferred embodiment, projections upward from the transom include hook portions 118*a*,118*b* which engage into recesses ('eyes') 122 provided on the transom end(s) of the brace(s).

It will be appreciated that the end portions 120 can include a respective attachment portion 124, such as a plug or collar, to connect into (as a plug) or over (as a collar) an end to the strut/brace. Attachment can be by bonding or rivet(s) or other fastener(s) or interference fit.

The projection(s) from the top of the transom preferably have a rearward facing hooked portion 118*a*,118*b*. Each projection may be provided as a hooked pin inserted into the top edge of the transom 32 and bonded into place. It will be appreciated that the hooked portion may alternatively be provided on the end(s) of the brace(s) and the recess provided on the respective projection(s).

The recess at the end of each strut/brace has an internal lip 126 so that when the brace is rotated over the projection, the hook engages with the lip and the brace is releasably attached to the projection until the brace is counter-rotated to a release position. The counter rotation is prevented by the seat catches when the seat is locked into the side panels, and therefore the boat can be carried by the two strokes.

When in use as braces, the braces are aligned below the hinge line of the transom i.e. the pivot axis through the connectors 36*a*,36*b*, and secure the transom so it can not rotate even if it escapes from the catches 42,44 locking the bottom of the transom to the bottom of the boat hull.

The struts may be omitted if the boat is only needed for light use applications, such as rowing, paddling or towing, or when only a low power (e.g. trolling) motor is used. For higher power outboard motors, the struts are utilised in order to ensure the transom member is not overloaded with forces from the motor i.e. the struts provide bracing to transfer loads into the rear seat and therefore to the sides of the boat.

The struts 69,71 can be discrete items that removably attach to the seat and transom, or can be pivotably/hingedly attached to the rear seat and releasably connected to the transom, or can be pivotably/hingedly attached to the transom and releasably connected to the seat.

Figure 6:
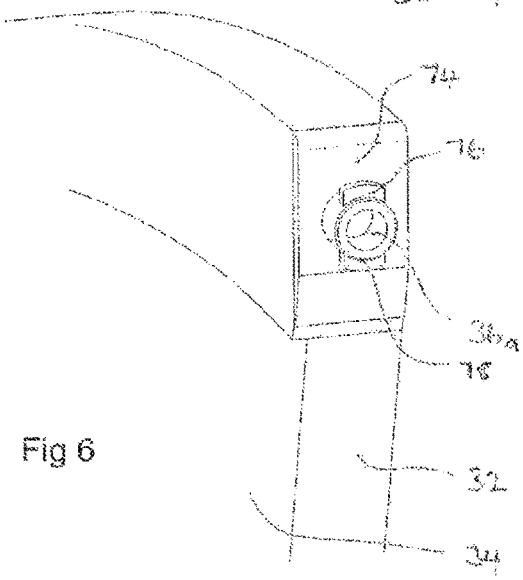
FIGS. 6 and 7 show respective attachment means to releasably attach the transom member to the sides of the boat hull.
Figure 7:
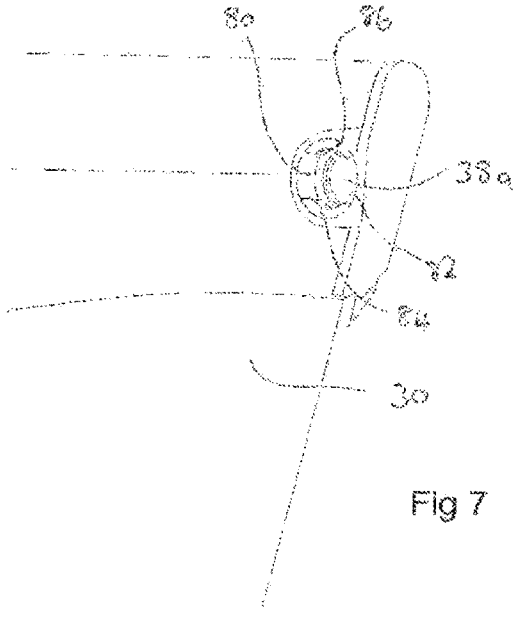

As shown in FIG. 6, the transom member in the embodiment shown includes attachment means 36*a* to connect the upper end 74 to a respective retaining means 38*a* (see FIG. 7) at an upper inside face of the side panel. The attachment means includes bayonet lugs 76,78 which engage into respective bayonet lug receiving portions 80,82 as shown in FIG. 7. As the transom member is rotated from a near horizontal position to its upright installed position, the bayonet lugs are retained by lug retaining portions 84,86 in the retainer of the side panel, on each side of the boat hull. This also acts to draw the sides to the transom for additional rigidity in the hull and better force transfer from the outboard motor to the sides when the boat is in use.

Latches 42, 44 are shown at the lower edge of the transom member in FIGS. 1 to 5. Each latch is arranged to be recessed into the transom member so that the operating mechanism for each latch and the handle 46 for each latch is discrete and the latch is relatively flush with the surface of the transom member.

Figure 8:
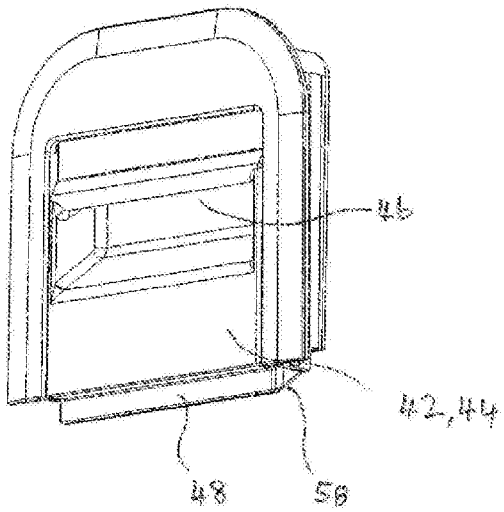
FIG. 8 shows a latch with release handle to be mounted to a transom member according to an embodiment of the present invention.

As shown in FIG. 8, each latch has a release handle 46 (e.g. in the form of a finger grip or trigger) to release the respective latch to allow the transom member to be pivoted up for subsequent release and removal from the boat hull. Each said latch also has a latch member 48 arranged to engage with a retaining member 54 on the bottom panel 16,18 of the boat hull (see FIG. 9).

The latch is released by lifting the release handle to operate and disengage the release latch from the retaining member.

Figure 9:
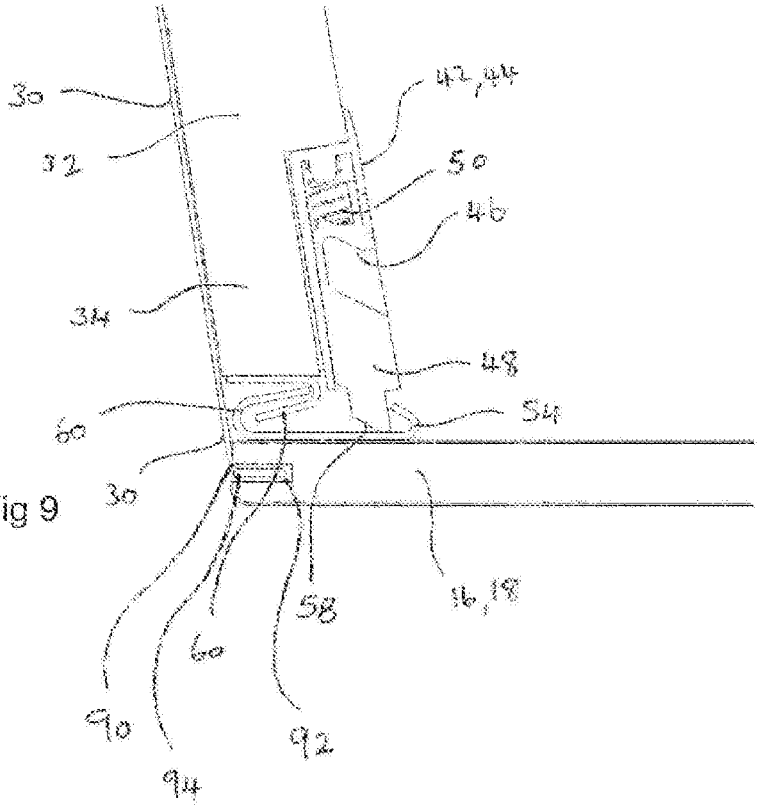
FIG. 9 shows, according to an embodiment of the present invention, a cross section through part of the transom member revealing an embodiment of the workings of the latch release mechanism to hold the transom in its upright position against external water pressure when installed.

As shown in the cross section in FIG. 9, the latch 42,44 is recessed into the lower portion of the transom member 32. The latch has a spring 50 biased combined handle and latch member, whereby lifting the latch member using the finger grip 46 disengages the latch member from the retaining member 54 on the bottom panel 56.

It will be appreciated that the latches are relatively wide and engage across a significant width with the retaining member on the bottom of the boat. This avoids point loads for integrity of the transom and adds strength to that connection. The wide connection also ensures good transfer of forces through the transom to the bottom of the boat.

The latch member has a bevelled face 58 that contacts the retaining, member 54 as the transom is pivoted into place and automatically causes the latch member 48 to lift against the spring bias when sufficient closing force is applied.

The transom member has a stop member 60 at its bottom face. The stop member contacts a stop 62 mounted to the bottom panel. In the embodiment shown, the stop 62 is integral to the retaining member on the bottom panel. This contact also hooks the stop member under a portion of the stop to help prevent or restrict downward movement of the bottom panel(s) relative to the transom. Essentially helping to lock the transom and bottom panel(s) together until released.

As shown in FIG. 9, the transom member abuts and supports a diaphragm 30 that is attached to the bottom panel (and to the side panels not shown in FIG. 9). An edge portion 90 of the diaphragm is retained in a recess 92 by a wedge or filet member 94 by an interference fit and/or sealing/adhesive agent for waterproofing Releasing the transom member involves lifting the release latch(es), pivoting the transom member inward with respect to the boat hull until the releasable fasteners at the upper edges of the transom can be released from the respective cooperating retainer on each side panel.

It will be appreciated that installing the transom using the features apparatus described and shown not only supports the diaphragm, but also adds rigidity to the hull by positively yet releasably attaching the side panels to brace the stern of the boat. The transom attachment means can positively pull the transom and side panels to each other to add rigidity to the hull.

Figure 10:
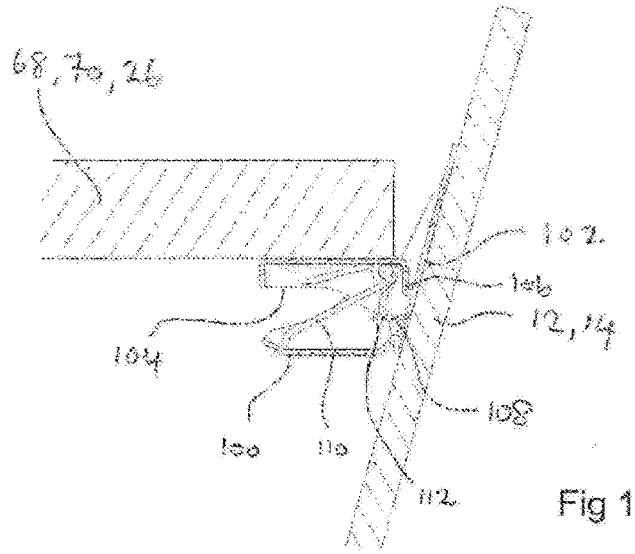
FIGS. 10 to 12 show, according to an embodiment of the present invention, various stages in releasing a seat clip (and therefore that end of the seat) from an attachment point on the interior face of the side panel.
Figure 11:
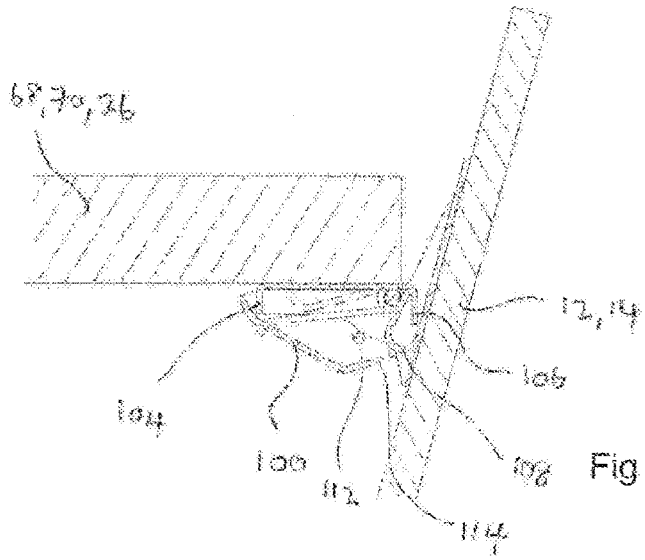
Figure 12:
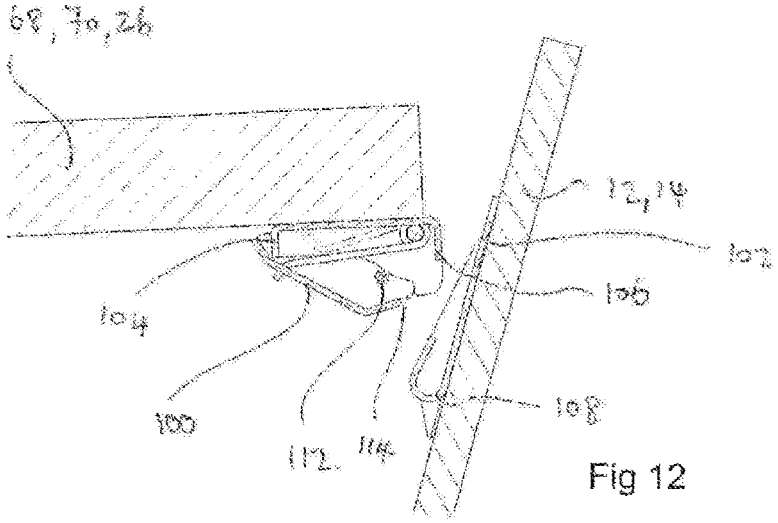

FIGS. 10 to 12 show stages in releasing a seat 68,70 or cross brace 26 from a side 12,14 of the boat. In FIG. 10, a release clip 100 of a catch 104 on the underside of the seat is engaged under a retainer 102 on the interior face of the side of the boat. A lip 106 of the catch engages into a hook shaped recess 108 on the retainer. The release clip is biased by a biasing means, such as a spring 110, to ensure the clip engages positively under the retainer to retain that end of the seat in place.

As shown in FIG. 11, the clip 100 is operated to a release position by rotation about a pivot 112. This releases the clip from engagement with the underside of the retainer and provides sufficient clearance to allow the seat/brace to be lifted away from the retainer.

Figure 13:
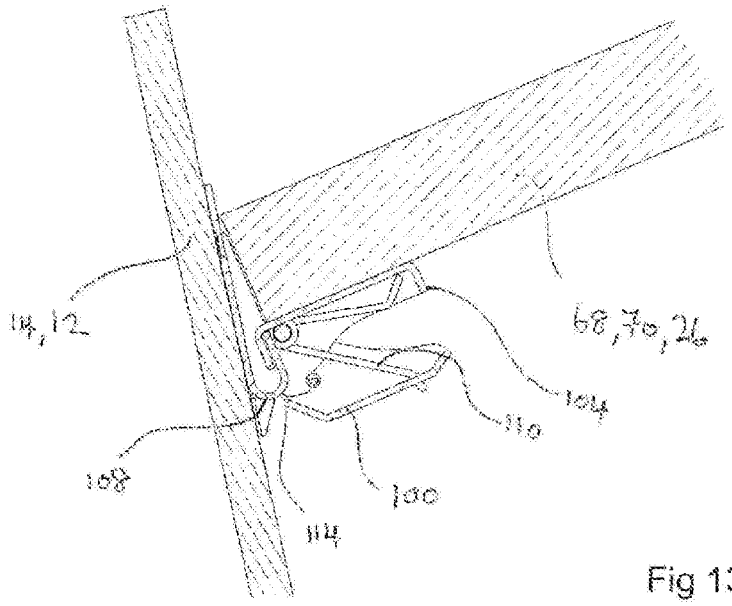
FIGS. 13 and 14, according to an embodiment of the present invention, show a tilt lift release of the seat clip from an opposite end of the seat compared to that shown in FIGS. 10 to 12.
Figure 14:
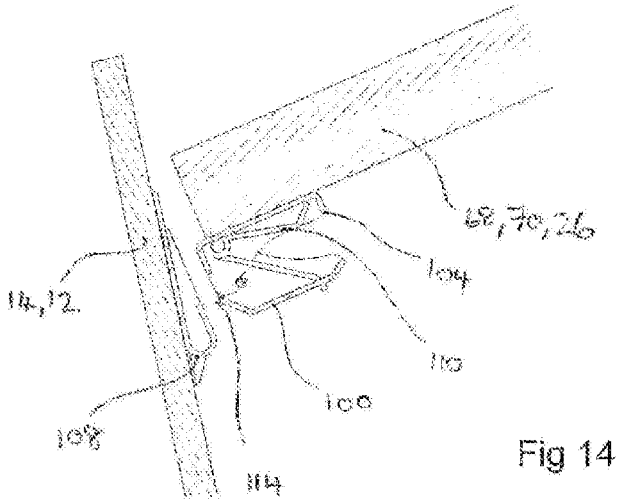

FIGS. 13 and 14 show the end of the seat 68,70 or brace 26 distal from the end shown in FIGS. 10 to 12 i.e. FIGS. 13 and 14 show the distal end of the seat 68, 70 or brace 26 opposite to the end that has been released and lifted shown in steps in FIGS. 10-12.

As can be seen in FIGS. 13 and 14, the clip 100 is not retracted for release, rather, as the seat or brace angles upwards, the jaw 114 of the clip rides under the retainer until it is clear of the retainer. This allows the lip 106 to lift out of the retainer. Thus, the seat or brace can advantageously be removed by a single user from one side of the boat hull.

Figure 15:
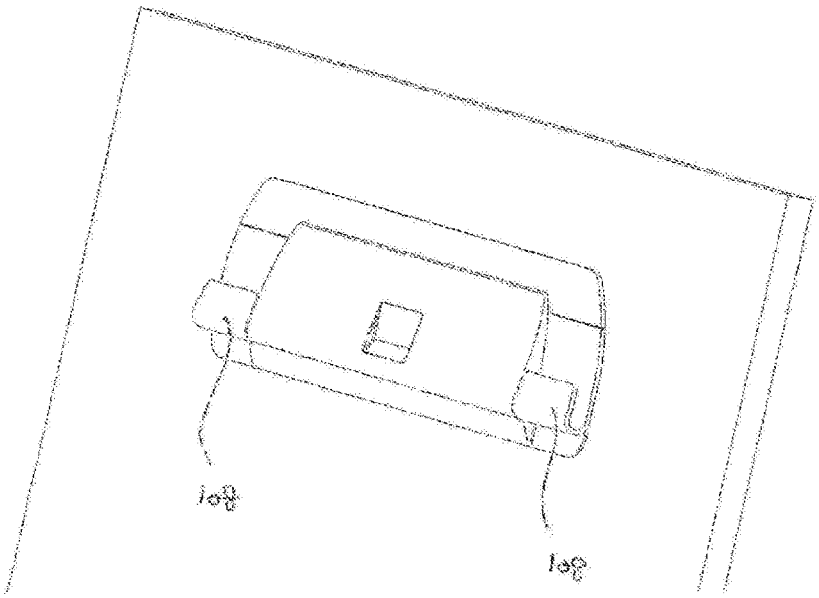
FIGS. 15 to 17, according to an embodiment of the present invention, show, respectively, detail of the attachment point on the side panel, the seat clip and the seat clipped into place within the boat hull.
Figure 16:
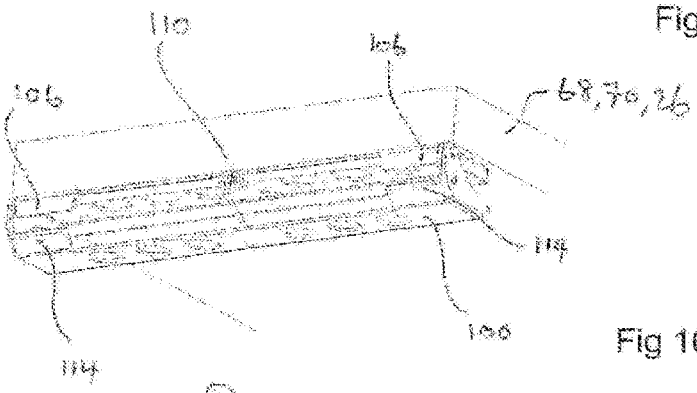
Figure 17:
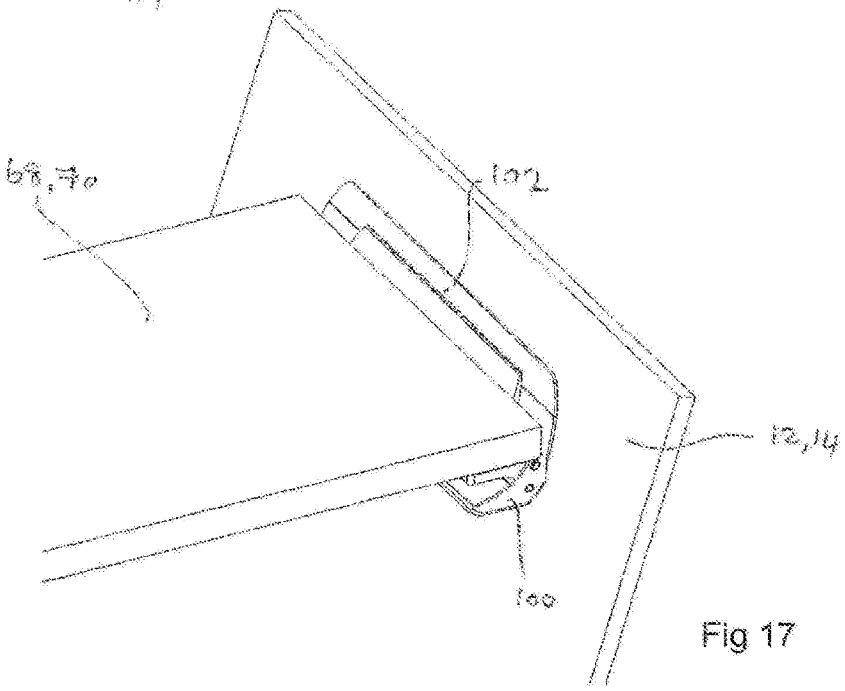

FIG. 15 shows the retainer 102 mounted to the interior surface of the boat side 12,14. The retainer has two recesses 108. The clip 100 is shown in FIG. 16. The clip has two lips 106 and two corresponding jaw portions 114, and a central spring biasing means 110. FIG. 17 shows the seat 68,70 locked into position with the clip engaged with the retainer to hold the seat end in place until released as described above.

The invention claimed is:

1. A collapsible boat hull comprising:

at least one bottom panel;

two side panels; and a removable transom member, the removable transom member including attachment means arranged to engage with the two side panels of the collapsible boat hull, such that, during installation of the removable transom member, the attachment means initially engages with the two side panels and rotation of the removable transom member to an upright position in the collapsible boat hull retains the attachment means and the two side panels of the collapsible boat hull together.

2. The collapsible boat hull according to claim 1, wherein the attachment means includes at least one bayonet or cam type releasable fastener to attach the removable transom member to the two side panels.

3. The collapsible boat hull according to claim 2, wherein the release or initial engagement position for the removable transom member with respect to the two side panels of the collapsible boat hull is horizontal or at an acute angle above or below horizontal.

4. The collapsible boat hull according to claim 2, wherein the two side panels or the removable transom member has a bayonet or cam arrangement of the at least one bayonet or cam type releasable fastener, and the other of the removable transom member or two side panels has a receiving arrangement for receiving the bayonet or cam arrangement.

5. The collapsible boat hull according to claim 1, including at least one releasable retaining means that prevents the removable transom member rotating back from its installed position.

6. The collapsible boat hull according to claim 5, the at least one releasable retaining means including at least one retaining portion mounted on the bottom of the collapsible boat hull, such that the at least one releasable retaining means maintains the removable transom member in an installed position until the at least one retaining means is released from the at least one retaining portion to allow the removable transom member to rotate to a release position for removal from the collapsible boat hull.

7. The collapsible boat hull according to claim 5, wherein the at least one retaining means includes a release arrangement.

8. The collapsible boat hull according to claim 7, the release arrangement including at least one release handle operatively connected to at least one respective retaining means release latch.

9. The collapsible boat hull according to claim 8, the at least one release handle may be provided in or on the removable transom member.

10. The collapsible boat hull according to claim 8, the at least one recessed release handle and release latch integral to a said release arrangement.

11. The collapsible boat hull according to claim 1, further including an elongate member extending between the two side panels of the collapsible boat hull.

12. The collapsible boat hull according to claim 11, further including at least one brace configured to extend between the elongate member and the removable transom member.

13. The collapsible boat hull according to claim 12, wherein the or each said brace includes releasable engagement means to releasably engage with the removable transom member or the elongate member or both the removable transom member and elongate member.

14. The collapsible boat hull according to claim 11, wherein the elongate member includes a seat, thwart or cross brace between the two side panels of the collapsible boat hull.

15. The collapsible boat hull according to claim 12 the removable transom including at least one brace connector arranged and configured to connect to the at least one brace.

16. The collapsible boat hull according to claim 15, wherein the at least one brace connector includes one or more projections extending from the removable transom member and including a respective connector portion on each said projection to engage with a corresponding portion on wherein the or each said brace.

17. The collapsible boat hull according to claim 15 wherein the at least one strut or brace connector and the at least one strut or brace include an inter-cooperating hook and recess arrangement, with one of the at least one strut or brace connector and respective strut or brace having at least one hook portion that releasably engages into at least one said recess provided on the other of the said at least one strut/brace and strut/brace connector.

18. The collapsible boat hull according to claim 15, wherein the at least one strut/brace extends to meet the removable transom member at a level below an upper edge of the removable transom member.

19. The collapsible boat hull according to claim 12, wherein the at least one strut/brace provides, when in use, a lifting and/or carrying handle to support transportation of the collapsible boat hull.

20. The collapsible boat hull according to claim 12, wherein the or each strut/brace is releasably removable from engagement with the removable transom member or the elongate member or both the removable transom member and the elongate member.

* * * * *